US010954746B2

(12) United States Patent
Murphy

(10) Patent No.: US 10,954,746 B2
(45) Date of Patent: Mar. 23, 2021

(54) ULTRA-COMPACT SUBSEA TREE

(71) Applicant: FMC Technologies, Inc., Houston, TX (US)

(72) Inventor: Richard M. Murphy, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 16/318,675

(22) PCT Filed: Jul. 26, 2017

(86) PCT No.: PCT/US2017/043978
§ 371 (c)(1),
(2) Date: Jan. 17, 2019

(87) PCT Pub. No.: WO2018/022770
PCT Pub. Date: Feb. 1, 2018

(65) Prior Publication Data

US 2019/0284901 A1 Sep. 19, 2019

Related U.S. Application Data

(60) Provisional application No. 62/367,488, filed on Jul. 27, 2016.

(51) Int. Cl.
*E21B 34/04* (2006.01)
*E21B 33/035* (2006.01)
*E21B 47/10* (2012.01)

(52) U.S. Cl.
CPC ..... *E21B 34/04* (2013.01); *E21B 33/035* (2013.01); *E21B 47/10* (2013.01)

(58) Field of Classification Search
CPC ..... E21B 34/04; E21B 33/035; E21B 47/10
See application file for complete search history.

(56) References Cited

U.S. PATENT DOCUMENTS 4,874,008 A * 10/1989 Lawson ..... E21B 34/04 137/315.09
5,992,527 A * 11/1999 Garnham ..... E21B 34/04 166/379

(Continued)

FOREIGN PATENT DOCUMENTS

GB 2357100 A 6/2001
GB 2459386 A 10/2009
WO WO 01/81710 A1 11/2001

*Primary Examiner* — Aaron L Lembo
(74) *Attorney, Agent, or Firm* — Henry C. Query, Jr.

(57) ABSTRACT

A subsea Christmas tree includes a valve block having a generally axially extending production bore, a first production branch which extends generally laterally through the valve block from the production bore to a side of the valve block, and a second production branch which extends generally laterally through the valve block from a first side of the valve block to a second side of the valve block. The first production branch has a first end which is connected to the flow bore and a second end which is located on the side of the valve block, and the second production branch has a first end which is located on the first side of the valve block and a second end which is located on the second side of the valve block. At least one flow component is connected to the valve block and includes, a first end in fluid communication with the second end of the first production branch and a second end in fluid communication with the first end of the second production branch. An outlet hub which is connected to or formed integrally with the valve block is connected to the second end of the second production branch. During the production mode of operation of the Christmas tree, production fluid is directed through the valve block through the first production branch to the flow component and then through the valve block through the second production branch to the outlet hub.

26 Claims, 17 Drawing Sheets

(56) References Cited

U.S. PATENT DOCUMENTS 6,076,605 A * 6/2000 Lilley ..... E21B 33/035 166/344
6,457,530 B1 * 10/2002 Lam ..... E21B 33/068 166/242.5
6,755,254 B2 * 6/2004 Deberry ..... E21B 33/035 166/368
6,840,323 B2 * 1/2005 Fenton ..... B01D 17/06 166/368
7,111,687 B2 * 9/2006 Donald ..... E21B 33/035 166/368
7,219,740 B2 * 5/2007 Saucier ..... E21B 33/035 166/344
7,331,396 B2 * 2/2008 Reimert ..... E21B 33/035 166/368
7,596,996 B2 * 10/2009 Zollo ..... E21B 33/03 73/152.29
7,992,633 B2 * 8/2011 Donald ..... E21B 33/068 166/75.12
8,297,360 B2 * 10/2012 Donald ..... E21B 33/035 166/364
8,550,170 B2 * 10/2013 McHugh ..... E21B 33/037 166/264
8,672,038 B2 * 3/2014 Tan ..... E21B 41/04 166/338
9,441,452 B2 * 9/2016 Donald ..... E21B 43/16
9,611,714 B2 * 4/2017 Donald ..... E21B 33/038
9,702,212 B2 * 7/2017 Breda ..... E21B 33/035
9,702,215 B1 * 7/2017 Murphy ..... E21B 33/076
10,174,575 B2 * 1/2019 Donald ..... E21B 33/076
10,184,310 B2 * 1/2019 McHugh ..... E21B 34/02
2005/0028984 A1 2/2005 Donald et al.
2005/0121198 A1 * 6/2005 Andrews ..... E21B 33/043 166/368
2007/0007012 A1 1/2007 Bartlett et al.
2008/0128139 A1 * 6/2008 White ..... E21B 33/038 166/368
2009/0260831 A1 * 10/2009 Moksvold ..... E21B 17/085 166/350
2010/0300700 A1 12/2010 Garbett et al.
2011/0061854 A1 3/2011 Davies
2015/0027730 A1 * 1/2015 Hall ..... E21B 34/02 166/379
2015/0075805 A1 3/2015 Donald et al.
2019/0136671 A1 * 5/2019 Espinasse ..... E21B 43/01

* cited by examiner

ULTRA-COMPACT SUBSEA TREE

The present application is based upon and claims priority from U.S. Provisional Patent Application No. 62/367,488 filed on Jul. 27, 2016.

BACKGROUND OF THE DISCLOSURE

The present disclosure is directed to a christmas tree for a subsea hydrocarbon production system. More particularly, the disclosure is directed to a christmas tree having a compact configuration which is both lighter and simpler to manufacture than conventional subsea trees.

SUMMARY OF THE DISCLOSURE

In accordance with the present disclosure, a subsea christmas tree is provided which comprises a valve block having a generally axially extending production bore, a first production branch which extends generally laterally through the valve block from the production bore to a side of the valve block, the first production branch comprising a first end which is connected to the production bore and a second end which is located on the side of the valve block, and a second production branch which extends generally laterally through the valve block from a first side of the valve block to a second side of the valve block, the second production branch comprising a first end which is located on the first side of the valve block and a second end which is located on the second side of the valve block; at least one flow component which is connected to the valve block, the flow component comprising a first end which is in fluid communication with the second end of the first production branch and a second end which is in fluid communication with the first end of the second production branch; and an outlet hub which is connected to the second end of the second production branch, the outlet hub being connected to or formed integrally with the valve block.

In one aspect of the disclosure, the first production branch extends from the production bore to the first side of the valve block. Thus the second end of the first production branch is located on the first side of the valve block.

In another aspect of the disclosure, the at least one flow component comprises a production flow loop which includes an inlet that is connected to the second end of the first production branch and an outlet that is connected to the first end of the second production branch.

In a further aspect of the disclosure, the christmas tree also comprises at least one of a production flow meter and a production choke which is positioned in the flow loop. For example, the christmas tree may comprise both a production flow meter and a production choke positioned in series in the production flow loop.

In yet another aspect of the disclosure, the production flow meter and/or the production choke form part of a flow module which is connected to the valve block. In this embodiment, the flow module may be retrievable independently of the valve block.

In one aspect of the disclosure, the inlet and outlet of the production flow loop are respectively connected to the second end of the first production branch and the first end of second production branch through a single multi-bore hub and connector arrangement.

In another aspect of the disclosure, the inlet of the production flow loop is connected to the second end of the first production branch through a first hub and connector arrangement and the outlet of the production flow loop is connected to the first end of the second production branch through a second hub and connector arrangement.

In a further aspect of the disclosure, the christmas tree further comprises a production master valve which is positioned in the production bore below the first production branch; a production wing valve which is positioned in the first production branch; and a production shut down valve which is positioned in the second production branch. In this embodiment, the production master valve, the production wing valve and the production shut down valve are mounted in the valve block.

In another aspect of the disclosure, the valve block further comprises a generally axially extending annulus bore and an annulus outlet which extends through the valve block from the annulus bore. In this embodiment, the christmas tree may also comprise an annulus master valve which is positioned in the annulus bore below the annulus outlet, and an annulus wing valve which is positioned in the annulus outlet. Furthermore, the annulus master valve and the annulus wing valve may be mounted in the valve block.

In a further aspect of the disclosure, the valve block further comprises a crossover bore which extends through the valve block from one of the production bore and the first production branch to one of the annulus bore and the annulus outlet. In this embodiment, the christmas tree may also comprise a crossover valve which is positioned in the crossover bore. Furthermore, the crossover valve may be mounted in the valve block.

The present disclosure is also directed to a subsea christmas tree comprising a valve block which comprises a production bore, a first production branch in fluid communication with the production bore, and a second production branch; at least one flow component which is connected to a first side of the valve block, the at least one flow component being in fluid communication with the first production branch and the second production branch; and an outlet hub which is connected to a second side of the valve block, the outlet hub being in fluid communication with the second production branch.

In one aspect of the disclosure, the first production branch extends from the production bore to the first side of the valve block and the second production branch extends from the first side of the valve block to the second side of the valve block.

In another aspect of the disclosure, the at least one flow component comprises at least one of a production flow loop, a production flow meter and a production choke.

In yet another aspect of the disclosure, the at least one flow component forms part of a flow module which is connected to the valve block.

In a further aspect of the disclosure, the flow module is retrievable independently of the valve block.

In another aspect of the disclosure, the first production branch and the second production branch are connected to the flow module through a single multi-bore hub and connector arrangement.

In yet another aspect of the disclosure, the first production branch is connected to the flow module through a first hub and connector arrangement and the second production branch is connected to the flow module through a second hub and connector arrangement.

In a further aspect of the disclosure, the christmas tree further comprises a production master valve which is positioned in the production bore below the first production branch; a production wing valve which is positioned in the first production branch; and a production shut down valve which is positioned in the second production branch. Thus, the production wing valve and the production shut down valve are mounted in the valve block.

In another aspect of the disclosure, the valve block further comprises a generally axially extending annulus bore and an annulus outlet which extends through the valve block from the annulus bore. In this embodiment, the christmas tree may further comprise an annulus master valve which is positioned in the annulus bore below the annulus outlet, and an annulus wing valve which is positioned in the annulus outlet. Furthermore, the annulus master valve and the annulus wing valve may be mounted in the valve block.

In a yet another aspect of the disclosure, the valve block further comprises a crossover bore which extends through the valve block from one of the production bore and the first production branch to one of the annulus bore and the annulus outlet. In this embodiment, the christmas tree may also comprise a crossover valve which is positioned in the crossover bore. Furthermore, the crossover valve may be mounted in the valve block.

The present disclosure is also directed to a method for controlling the flow of fluid from a hydrocarbon well. In one aspect, the method comprises the steps of mounting a valve block over an upper end of the well; directing the fluid through the valve block to a flow component which is connected to the valve block; directing the fluid through the flow component; and then directing the fluid back through the valve block to an outlet hub which is coupled to the valve block.

In an aspect of the disclosure, the flow component may comprise at least one of a production flow loop, a production flow meter and a production choke.

Thus, it may be seen that a novel and beneficial feature of the compact tree of the present disclosure is the incorporation of a second production branch through which the production fluid re-enters the valve block after it passes through the flow module. Thus, rather than utilizing external flow loops to route the production fluid to a tree outlet hub, the production fluid is routed to another side of the tree via the second production branch. The elimination of external flow loops minimizes the weight of the tree and simplifies the manufacturing process (e.g., welding) associated with installing flow loops on a subsea tree. Also, the outlet hub is preferably directly attached to the valve block so as to transfer at least a portion of the loads associated with an attached flowline through the structure of the valve block, instead of through a separate fabricated structure which is attached to the tree, thus reducing the weight, size and overall cost of the tree assembly.

These and other objects and advantages of the present disclosure will be made apparent from the following detailed description, with reference to the accompanying drawings. In the drawings, the same reference numbers may be used to denote similar components in the various embodiments.

DETAILED DESCRIPTION

Figure 1:
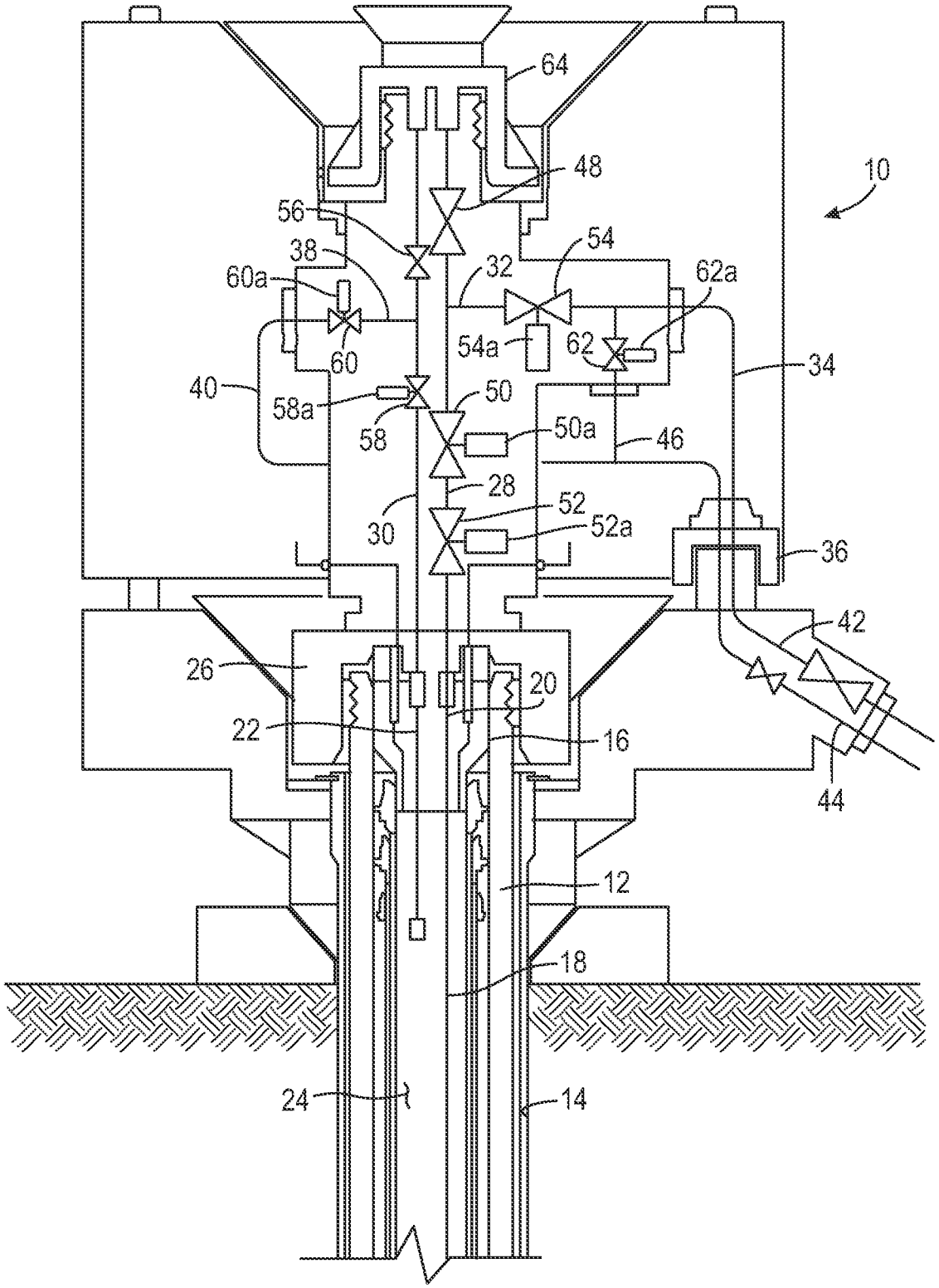
FIG. 1 (Prior Art)
FIG. 1 is a schematic representation of a prior art vertical christmas tree.

As background for the present disclosure, an example of a prior art christmas tree will be described with reference to FIG. 1. The prior art tree, generally 10, comprises part of a subsea hydrocarbon production system that also includes a wellhead 12 which is positioned at the upper end of a well bore 14, a tubing hanger 16 which is landed in the wellhead, and a production tubing string 18 which extends from the tubing hanger into the well bore. The tubing hanger comprises an axially extending production bore 20 which is connected to the tubing string 18 and an axially extending annulus bore 22 which is connected to a production annulus 24 surrounding the tubing string.

The tree 10 is installed on the top of the wellhead 12 and is locked thereto using a conventional hydraulic connector 26. The tree 10 includes a production bore 28 which is connected to the tubing hanger production bore 20 and an annulus bore 30 which is connected to the tubing hanger annulus bore 22. The production bore 28 is connected to a lateral production outlet 32 which in turn is connected via a production flow loop 34 to a flowline connector 36. Similarly, the annulus bore 30 is connected to a lateral annulus outlet 38 which in turn is connected via an annulus flow loop 40 to the flowline connector 36. The flowline connector 36 connects the production flow loop 34 to a production flowline 42 and the annulus flow loop 40 to an annulus flowline 44. The production flowline 42 and the annulus flowline 44 may in turn be connected to, e.g., a conventional bridge module or manifold module (not shown). Also, the production outlet 32 and the annulus flow loop 40 may be connected via a crossover line 46.

The tree 10 comprises a number of valves for controlling fluid flow through the hydrocarbon production system. In particular, a production swab valve ("PSV") 48 is located in the production bore 28 above the production outlet 32, an upper production master valve ("UPMV") 50 is located in the production bore below the production outlet, a lower production master valve ("LPMV") 52 is located in the production bore below the UPMV, and a production wing valve ("PWV") 54 is located in the production outlet between the production bore and the production flow loop 34. In addition, an annulus swab valve ("ASV") 56 is located in the annulus bore 30 above the annulus outlet 38, an annulus master vale ("AMV") 58 is located in the annulus bore below the annulus outlet, an annulus wing valve ("AWV") 60 is located in the annulus outlet between the annulus bore and the annulus flow loop 40, and a crossover valve ("XOV") 62 is located in the crossover line 46 between the production outlet and the annulus flow loop.

During the production mode of operation of the tree 10, the UPMV 50, LPMV 52 and PWV 54 are opened and the PSV 48 and XOV 62 are closed. In this configuration, the produced fluid will be directed from the production bore 28 into the production outlet 32 and from there into the production flow loop 34 and the production flow line 42. In addition to the PSV 48, a tree cap 64 or similar device is locked and sealed to the top of the tree 10 to provide a second pressure barrier between the production bore 28 and the environment. The UPMV 50 and the LPMV 52 typically remain open except in the event of an emergency, when the well is shut down, or when needed to provide a pressure barrier between the well bore and the environment, such as when the tree cap 64 is removed in preparation for the installation of intervention equipment.

Figure 2:
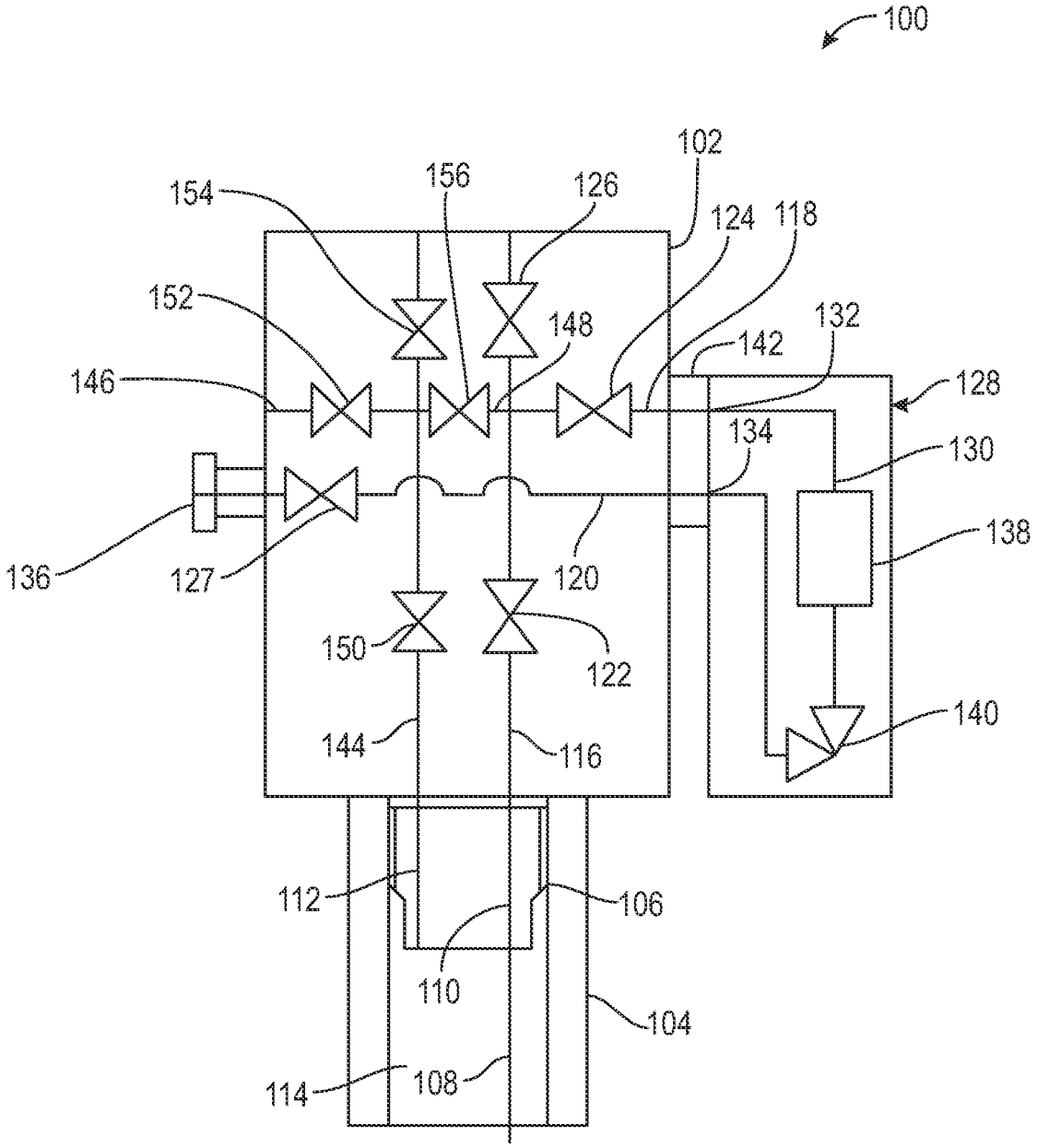
FIG. 2 is a schematic representation of a first embodiment of the christmas tree of the present disclosure.

A first embodiment of the ultra-compact christmas tree of the present disclosure is shown in FIG. 2. The tree of this embodiment, generally 100, comprises a valve block 102 which is configured to be mounted on a wellhead 104 (or tubing head or similar such component). The wellhead 104, which is located at the top of a well bore, supports a tubing hanger 106 which is connected to the top of a production tubing string 108 that extends into the well bore. The tubing hanger includes a generally axially extending production bore 110 which is connected to the tubing string 108 and a generally axially extending annulus bore 112 which communicates with a production tubing annulus 114 surrounding the tubing string.

The tree 100 comprises a production bore 116 which extends axially through the valve block 102 and is connected to the tubing hanger production bore 110, a production outlet (or "first production branch") 118 which extends laterally through the valve block as is connected to the production bore, and a production branch (or "second production branch") 120 which extends laterally through the valve block 102. The production branch 120 is not limited to the configuration and arrangement shown in FIG. 2 and can, for instance, pass at oblique angles through the valve block 102 and exit at other points of the valve block 102, including other sides of the valve block 102. The tree includes a number of valves for controlling fluid flow through the valve block 102, such as a production master valve ("PMV") 122 which is located in the production bore 116 below the production outlet 118, a production wing valve ("PWV") 124 which is located in the production outlet, a production swab valve ("PSV") 126 which is located in the production bore above the production outlet, and an optional production shut down valve ("PSDV") 127 which is located in the production branch 120.

In one embodiment of the disclosure, the PMV 122 and PWV 124 are fail-safe-closed, remotely (such as electrically or hydraulically) actuated, and preferably gate valves, although other types of valves, such as ball valves, may provide suitable alternatives. The PSV 126 and PSDV 127 may in one embodiment comprise manually (such as ROV) operated valves, but in other embodiments the PSV and/or the PSDV may be fail-safe-closed, hydraulically or electrically operated valves, similar to the PMV 122 and the PWV 124. While the production bore 116 may be located at the centerline of the valve block 102, the actuators for the valves (not shown) may extend from different sides of valve block 102. Thus, the physical size of the tree 100 can be minimized.

The tree 100 also includes one or more flow components which may in an illustrative embodiment of the disclosure be incorporated into a flow module 128 which is positioned on a side of the valve block 102. As depicted, the flow components include a production loop 130 having an inlet 132 which is connected to the production outlet 118 and an outlet 134 which is connected to the production branch, as well as a production flow meter 138, which may comprise a multi-phase or a single phase flow meter, and a production choke 140 for regulating the production flow and balancing the production flow with the production flow from other trees that may be manifolded together with the tree 100. The tree 100 is not limited, however, to the flow components and their associated arrangement shown in FIG. 2.

In the production mode of operation of the tree 100, the PMV 122 and the PWV 124 will be in the open position and the PSV 126 will be in the closed position. Thus, production fluids entering the valve block 102 through production bore 116 will be directed into the production outlet 118, through the flow module 128, and back through the production branch 120. From the production branch 120, the production fluids will be directed into a flowline (not shown) which is connected in a conventional manner to an outlet hub 136 located on a side of the valve block 102.

In the illustrative embodiment of the disclosure shown in FIG. 2, the flow components positioned at the side of the valve block 102, such as the flow meter 138 and the choke 140, are incorporated into the flow module 128, which is at least partially responsible for monitoring and controlling the production flow through the tree 100. The flow module 128 may be an independently-retrievable module which is attached to valve block 102 using one or more hubs and connectors, or it may be permanently mounted to or even formed integrally with the valve block 102. In the embodiment of the disclosure shown in FIG. 2, for example, the flow module 128 is connected to the valve block using a conventional multi-bore hub and connector arrangement 142. Although a horizontally connected flow module 128 is shown in FIG. 2, the flow module may alternatively be attached to the tree using a vertically-oriented multi-bore hub. If the flow module 128 is permanently mounted to or formed integrally with the valve block 102, then the flow meter 138 and/or the choke 140 may be or include retrievable components to allow them to be repaired or serviced without necessitating the retrieval of the entire tree 100—although the tree will ideally be sufficiently light to be retrieved without the need for extensive topside equipment. In that case, the entire tree 100 may be retrieved if any of its components need servicing.

As is conventional with vertical-type christmas trees, the tree 100 also includes an annulus bore 144 which extends through the valve block 102 and is connected to the tubing hanger annulus bore 112, an annulus outlet 146 which extends through the valve block and is connected to the annulus bore, and a crossover bore 148 which extends through the valve block between the annulus bore and the production bore (or between the annulus bore and the production outlet, or between the annulus outlet and the production bore, or between the annulus outlet and the production outlet). Together with the tree production bore 116, the tubing hanger production bore 110, the production tubing 108 and the production annulus 114, the annulus bore 144, the annulus outlet 146 and the crossover bore 148 allow for fluid circulation during well completion and shut-in operations.

In the embodiment of the disclosure shown in FIG. 2, the tree 100 includes an annulus master valve ("AMV") 150 which is located in the annulus bore 144 below the annulus outlet 146, an annulus wing valve ("AWV") 152 which is located in the annulus outlet, an annulus swab valve ("ASV") 154 which is located in the annulus bore above the annulus outlet, and a crossover valve ("XOV") 156 which is located in the crossover passage 148. As with the production valves described above, the annulus valves may be hydraulically, electrically or manually actuated. In one embodiment of the disclosure, the AMV 150, the AWV 152 and the XOV 156 are remotely actuated (hydraulic or electric) valves and the ASV 154 is a manually (ROV) actuated valve. Similar to the production valve actuators, the annulus valve actuators (not shown) may be located on different sides of the valve block 102.

It should be noted that, although the compact tree 100 is shown with a particular arrangement of production and annulus passages and valves, any of the compact tree embodiments described herein could comprise different configurations of production and annulus passages and different types of valves and closure devices, depending on the application for which the compact tree is designed. In this regard, reference is made to ANSI/API Specification 17D, "Design and Operation of Subsea Production Systems—Subsea Wellhead and Tree Equipment" (2013), which is hereby incorporated herein by reference, for examples of different tree configurations which the compact tree of the present disclosure may be designed to comprise.

Figure 3:
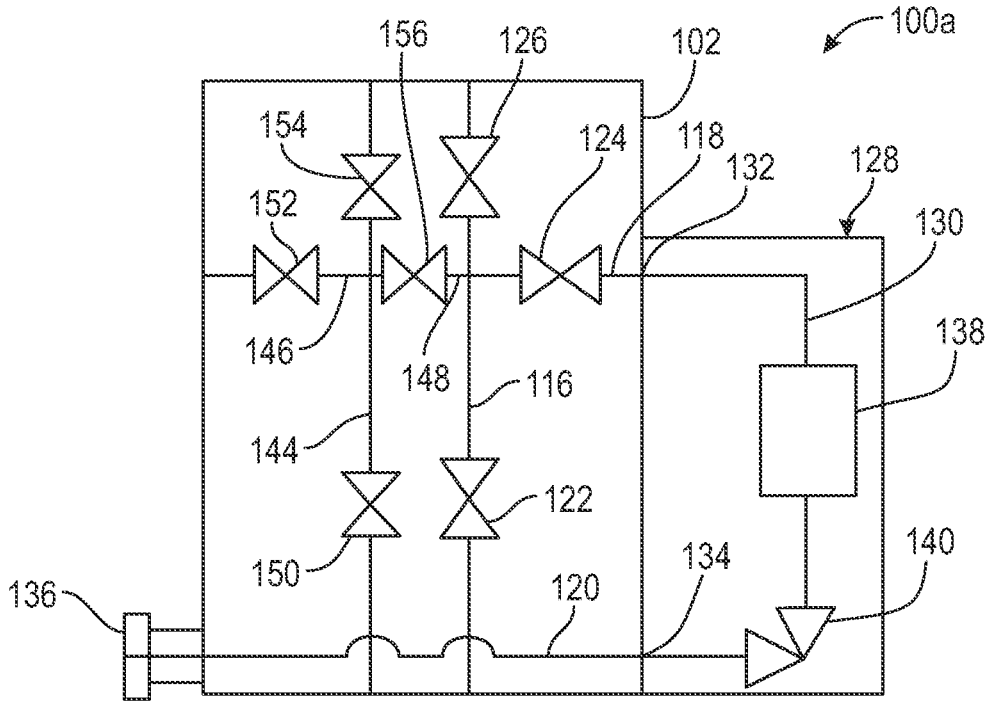
FIG. 3 is a schematic representation of a second embodiment of the christmas tree of the present disclosure.

Another embodiment of the ultra-compact tree of the present disclosure is shown in FIG. 3. The compact tree of this embodiment, generally 100*a*, is similar in most respects to the compact tree 100 described above. In the present embodiment, however, the flow module 128 is mounted directly to the valve block 102 and the inlet 132 and outlet 134 of the production loop 130 are directly connected to the production outlet 118 and production branch 120, respectively. As with the tree 100*a*, the flow module 128 may be independently-retrievable, permanently mounted to or formed integrally with the valve block 102, and the flow meter 138 and/or the choke 140 may be or include retrievable components to allow them to be repaired or serviced without necessitating the retrieval of the entire tree 100*a*.

Figure 4:
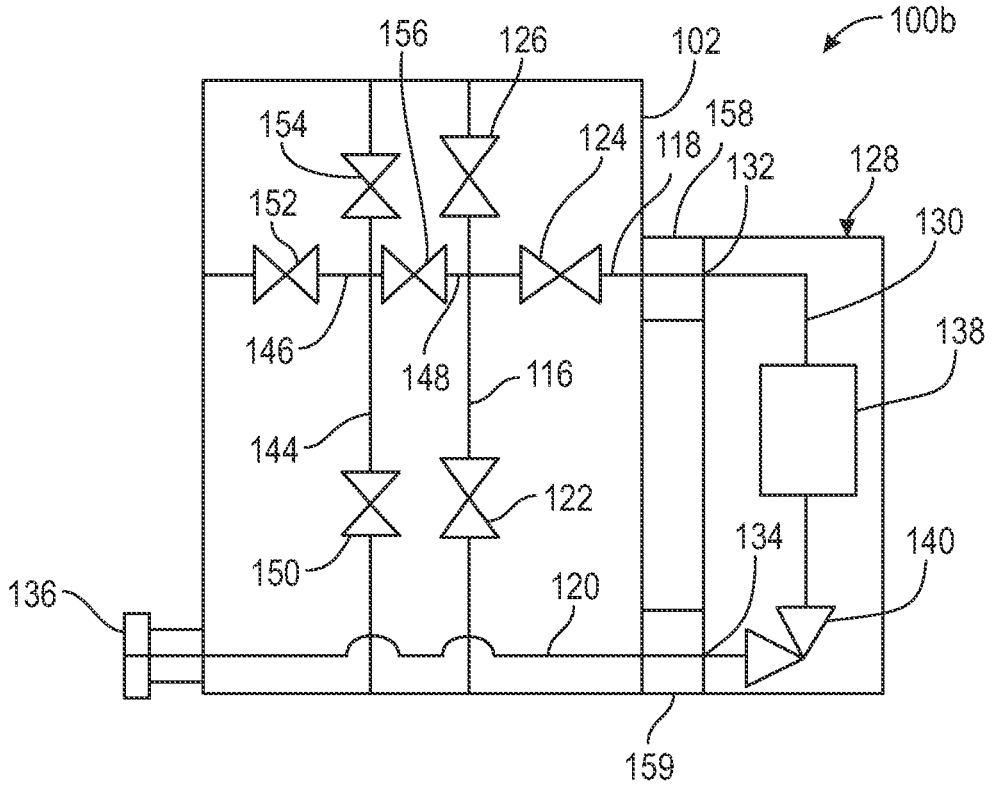
FIG. 4 is a schematic representation of a third embodiment of the christmas tree of the present disclosure.

A third embodiment of the compact tree of the present disclosure is shown in FIG. 4. The compact tree of this embodiment, generally 100*b*, is similar in most respects to the compact tree 100 described above. In the present embodiment, however, the flow module 128 is connected to the valve block 102 via conventional first and second hubs and connector arrangements 158, 159. As shown in FIG. 4, the first hub and connector arrangement 158 connects the production outlet 118 with the inlet 132 of the production loop 130, and the second hub and connector arrangement 159 connects the production branch 120 with the outlet 134 of the production loop. In this embodiment, as well as in the embodiment of FIG. 2, the hubs and connectors may be oriented vertically to facilitate the retrieval and installation of the flow module 128 from a surface vessel using a wireline or cable. Also, as with the previous embodiments, the flow module 128 may be independently-retrievable, permanently mounted to or formed integrally with the valve block 102, and the flow meter 138 and/or the choke 140 may be or include retrievable components to allow them to be repaired or serviced without necessitating the retrieval of the entire tree 100*b*.

As an alternative to the flow module 128 described above, the flow meter 138 and/or the choke 140 (and/or any other flow monitoring and/or flow control component) may be mounted in respective housings which are connected to or formed integrally with the valve block 102 using conventional means. In such an embodiment, the production loop 130 would be routed from the production outlet 118, through the component or components, and then back to the production branch 120.

A novel and beneficial feature of the compact tree of the present disclosure is the incorporation of the production branch 120 through which the production fluid re-enters the valve block 102 after it passes through the flow module 128. Rather than utilizing external flow loops to route the production fluid to a tree outlet hub, the production fluid is routed to another side of the tree via the production branch 120. The elimination of external flow loops minimizes the weight of the tree and simplifies the manufacturing process (e.g., welding) associated with installing flow loops on a subsea tree. Also, the outlet hub 136 is preferably directly attached to the valve block 102 so as to transfer at least a portion of the loads associated with an attached flowline through the structure of the valve block, instead of through a separate fabricated structure which is attached to the tree, thus reducing the weight, size and overall cost of the tree assembly. Similar to hubs 142, 158 and 159, outlet hub 136 may also be a horizontal hub, as shown in the Figures, or a vertically-oriented hub (not shown).

Figure 5:
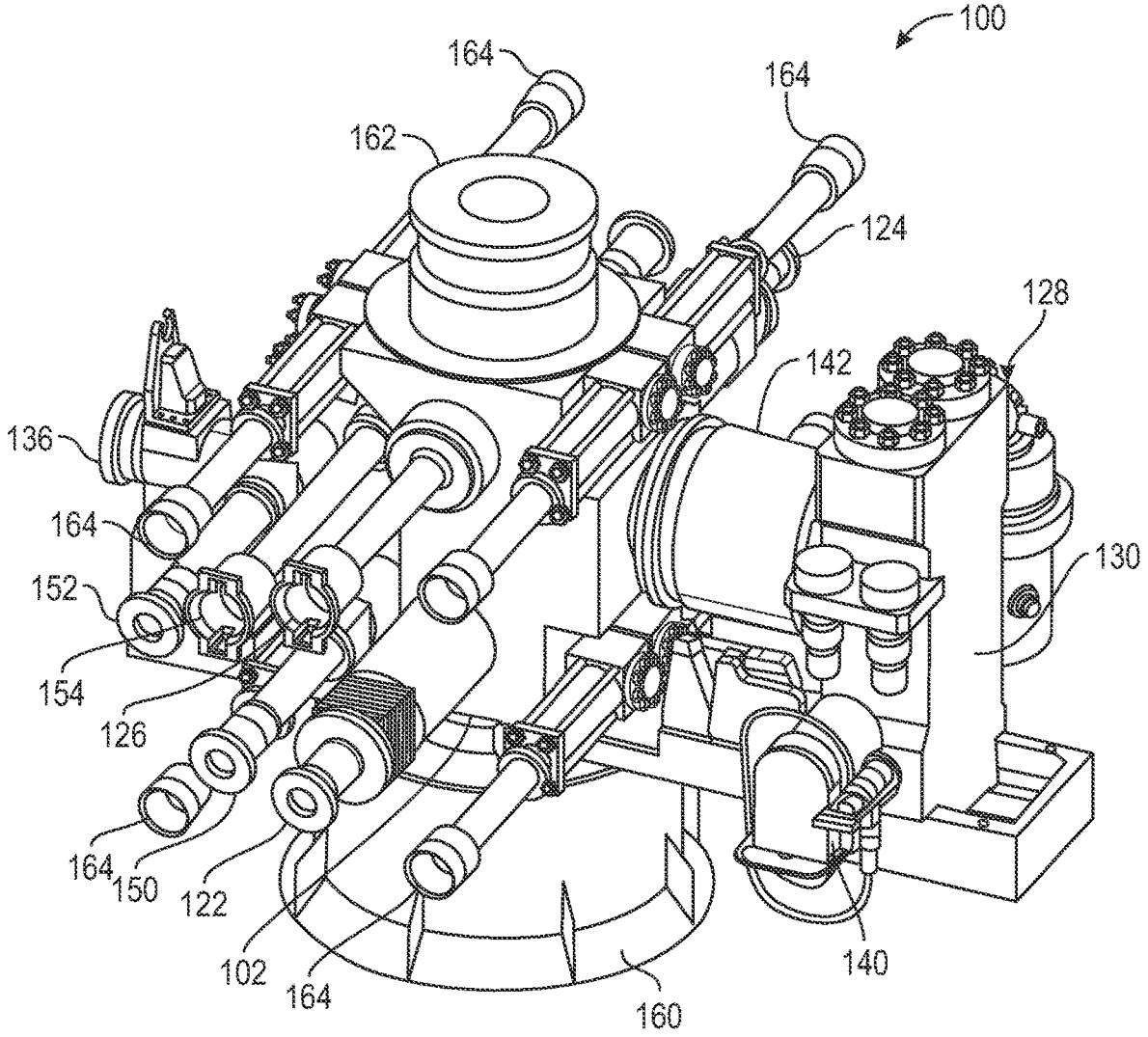
FIG. 5 is a perspective view of another embodiment of the christmas tree of the present disclosure.
Figure 6:
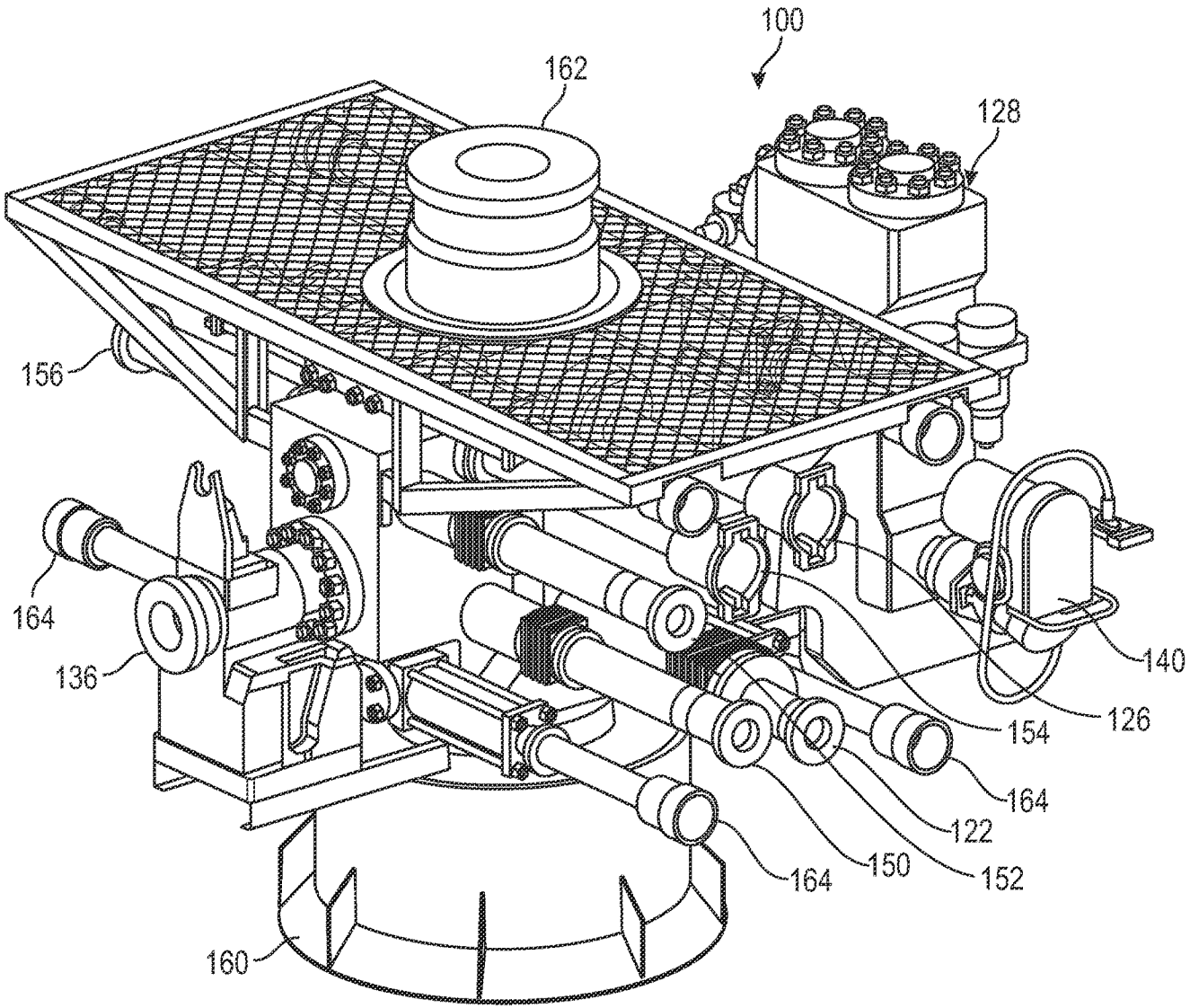
FIG. 6 is another perspective view of the embodiment of the christmas tree shown in FIG. 5.
Figure 7:
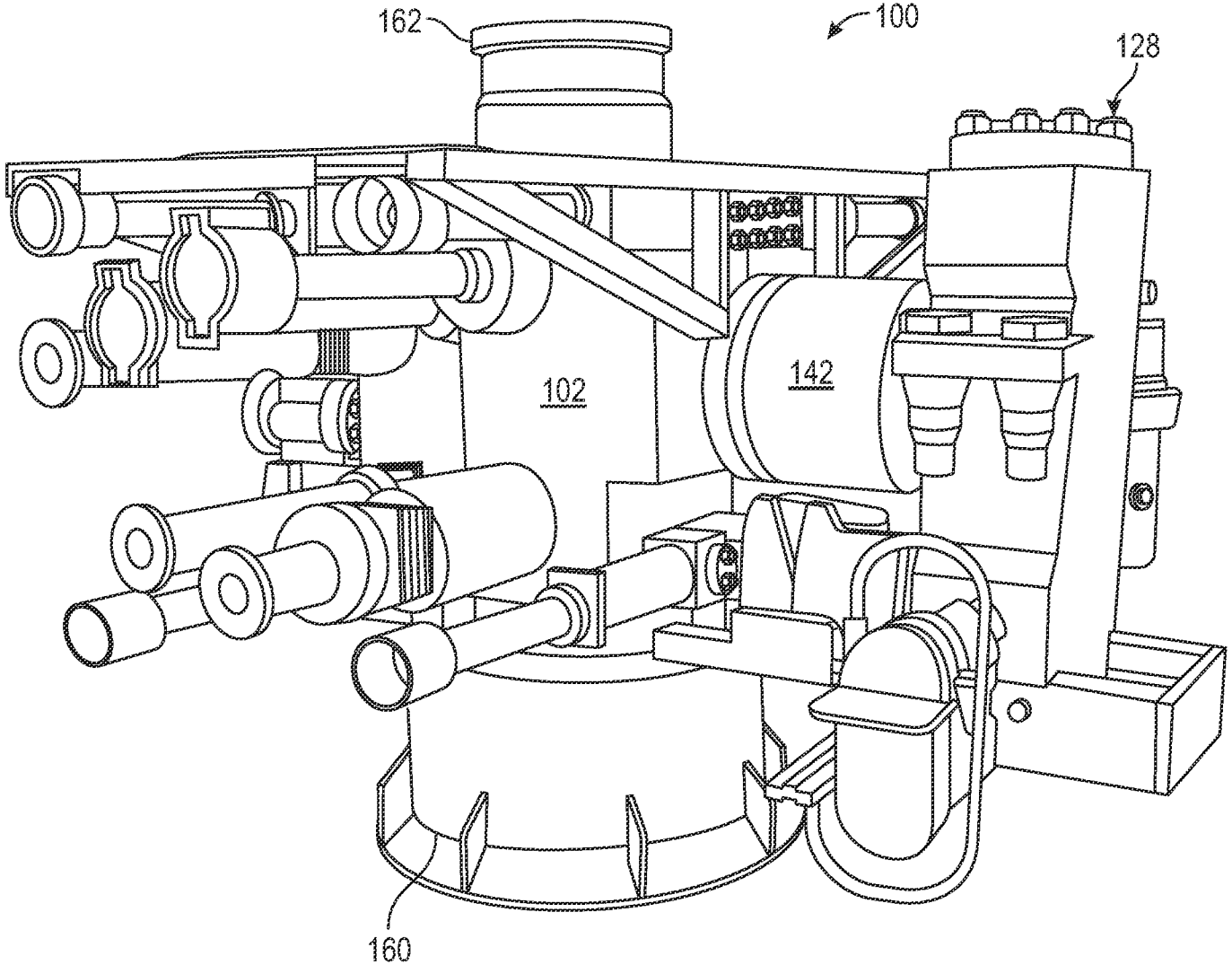
FIGS. 7-18 are three dimensional depictions of another embodiment of the christmas tree of the present disclosure taken from various angles.

Referring also to FIGS. 5 and 6, the ultra-compact tree of the present disclosure also comprises a conventional subsea connector 160 for securing the valve block 102 to the wellhead 104, and a mandrel 162 which is connected to or formed integrally with the valve block 102 and extends from the top of the tree to provide vertical access to the production bore 116 and the annulus bore 144. The mandrel 162 may include both internal and external locking profiles to allow installation and service equipment to attach and seal to the top of tree 100. The tree 100 may also include additional valves, such as chemical injection valves 164, which in one embodiment are manually (e.g., ROV) operated valves but may also be remotely actuated (e.g., electrically or hydraulically) valves.

Figure 8:
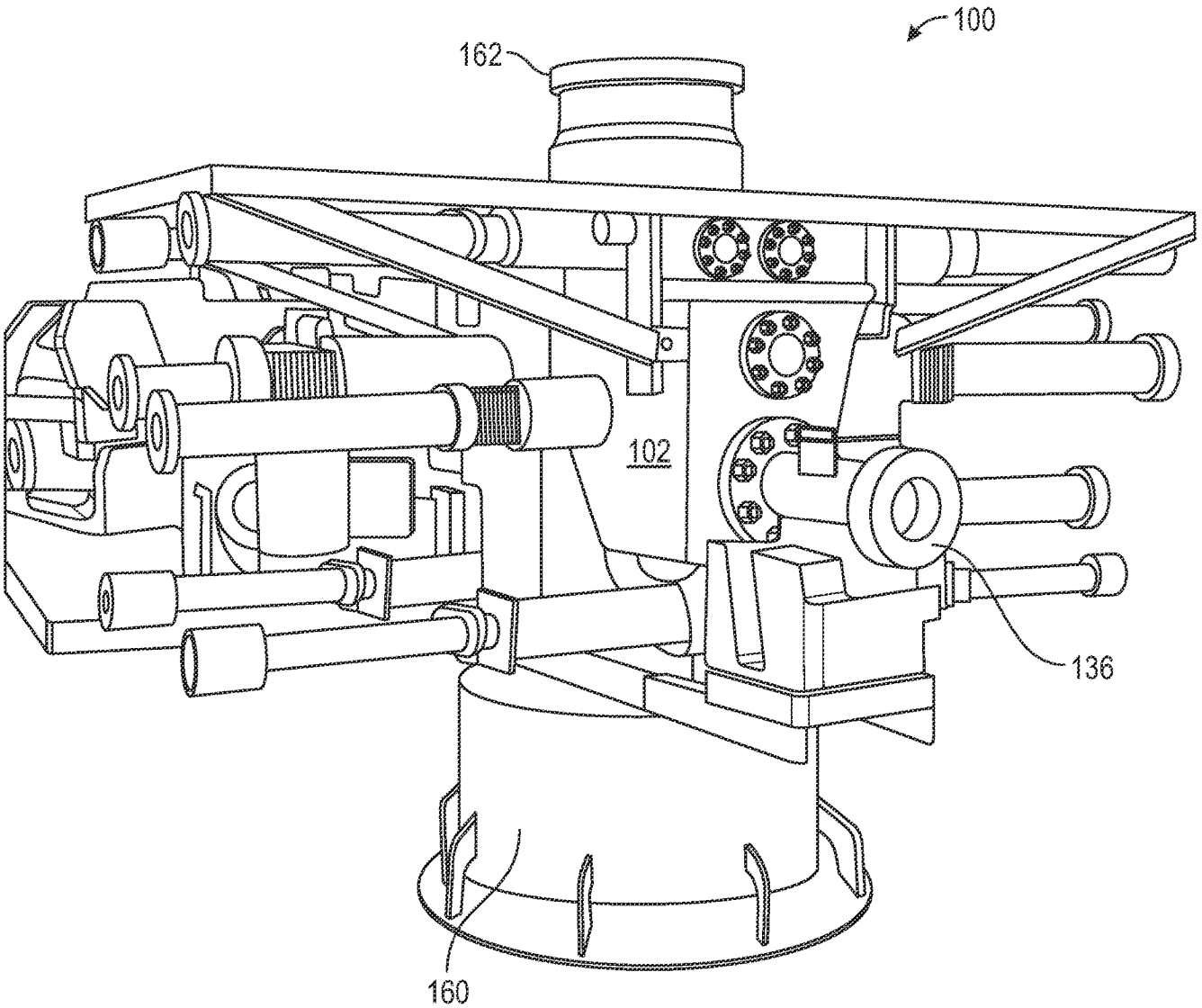
Figure 9:
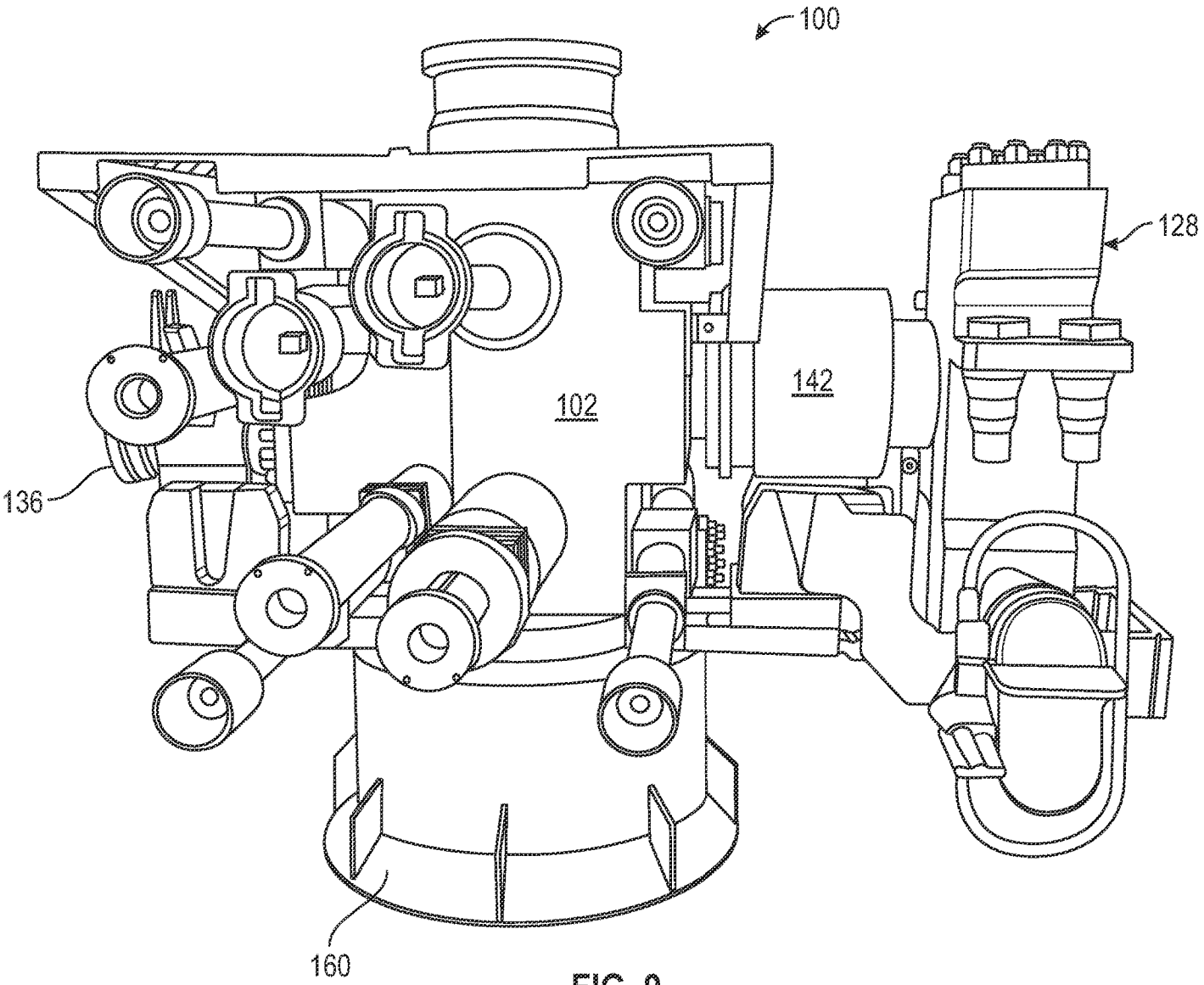
Figure 10:
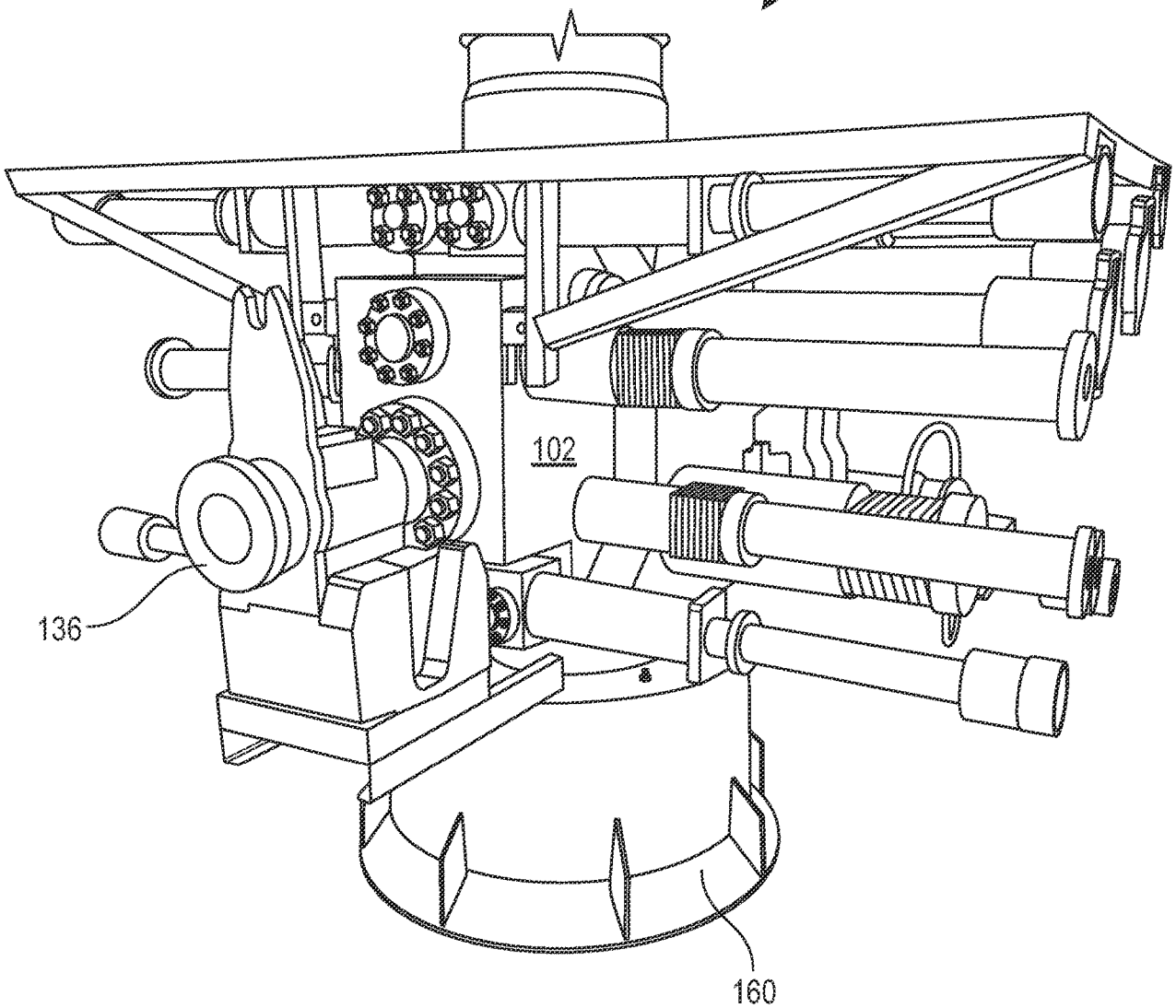
Figure 11:
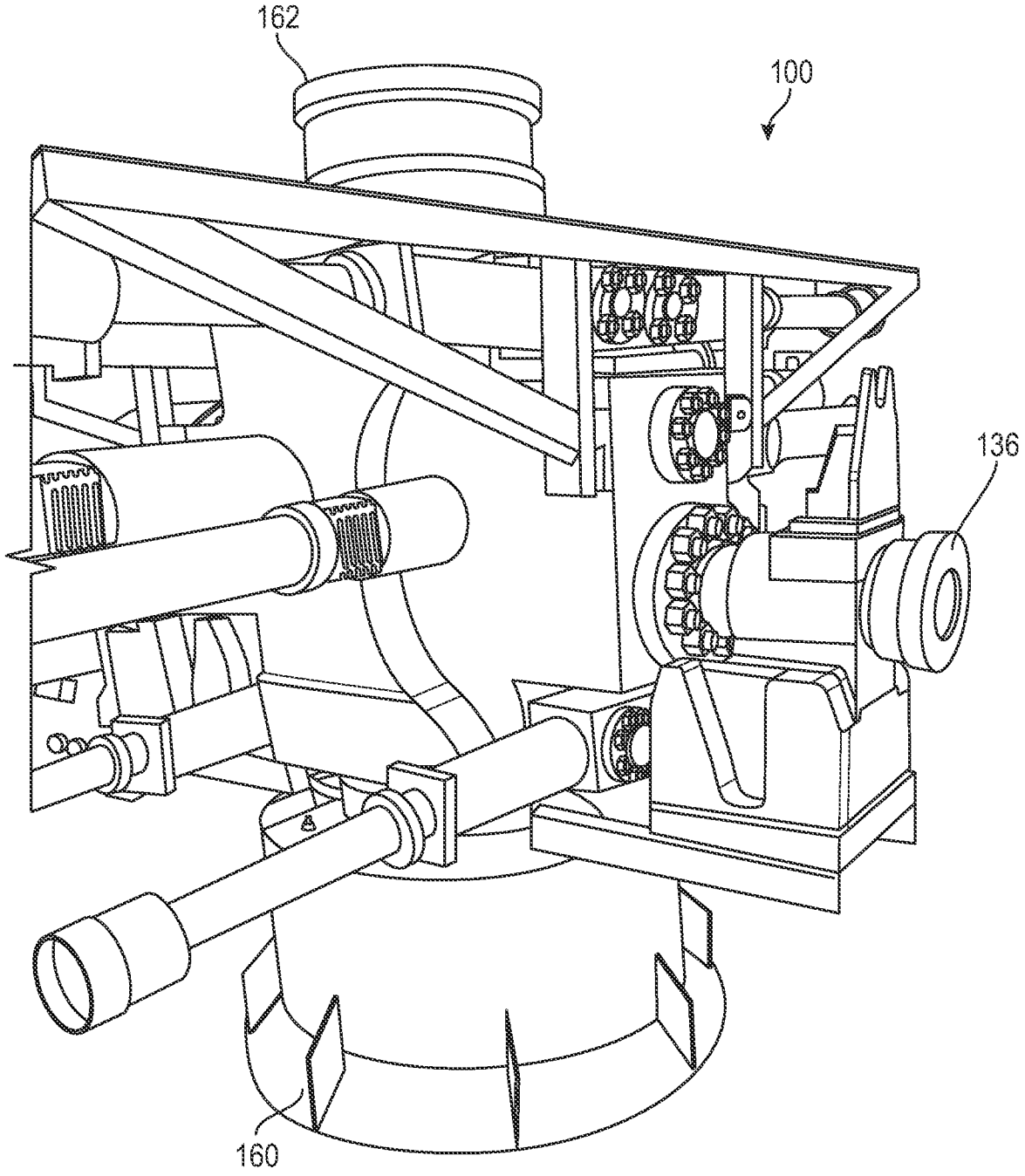
Figure 12:
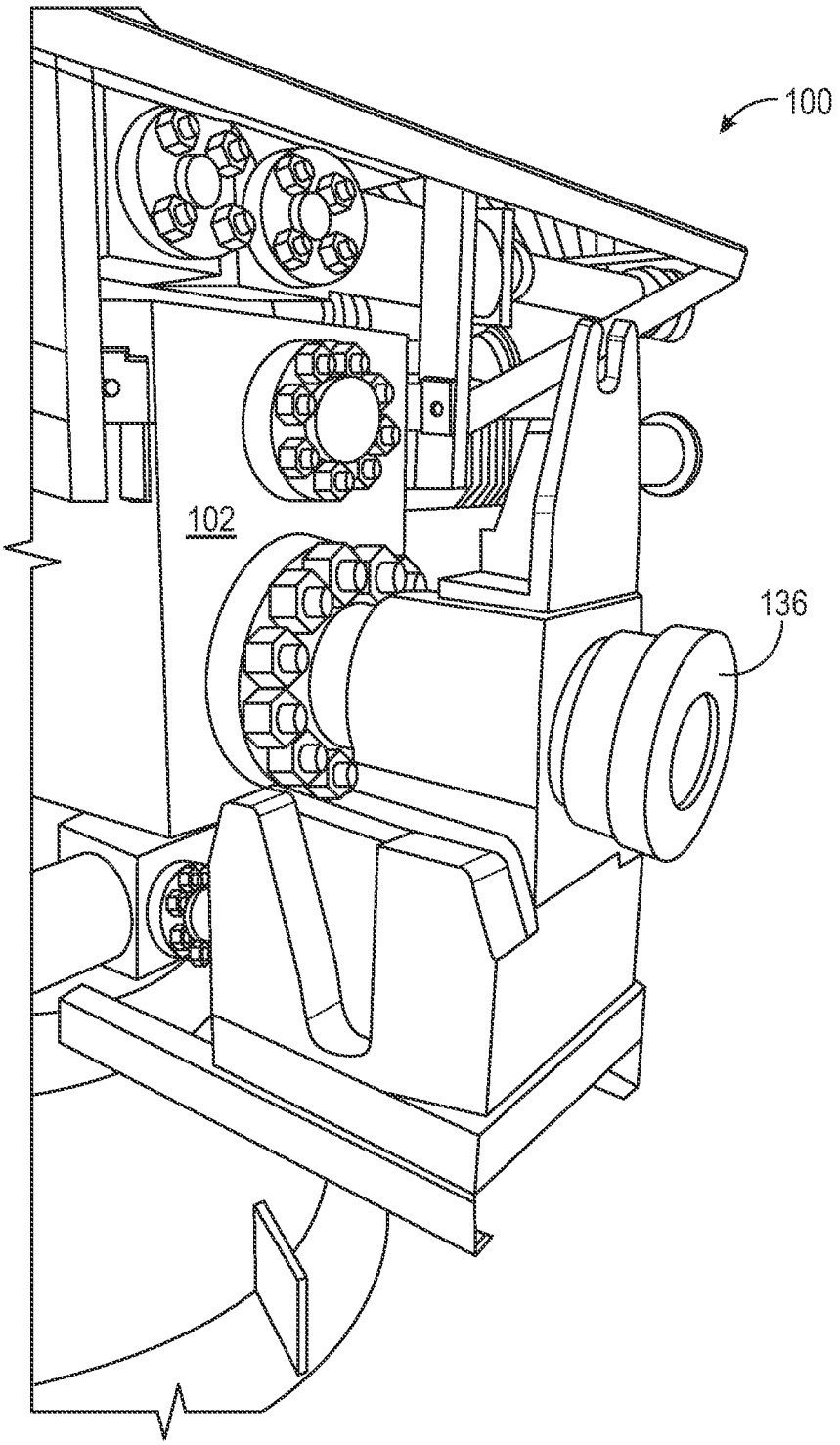
Figure 13:
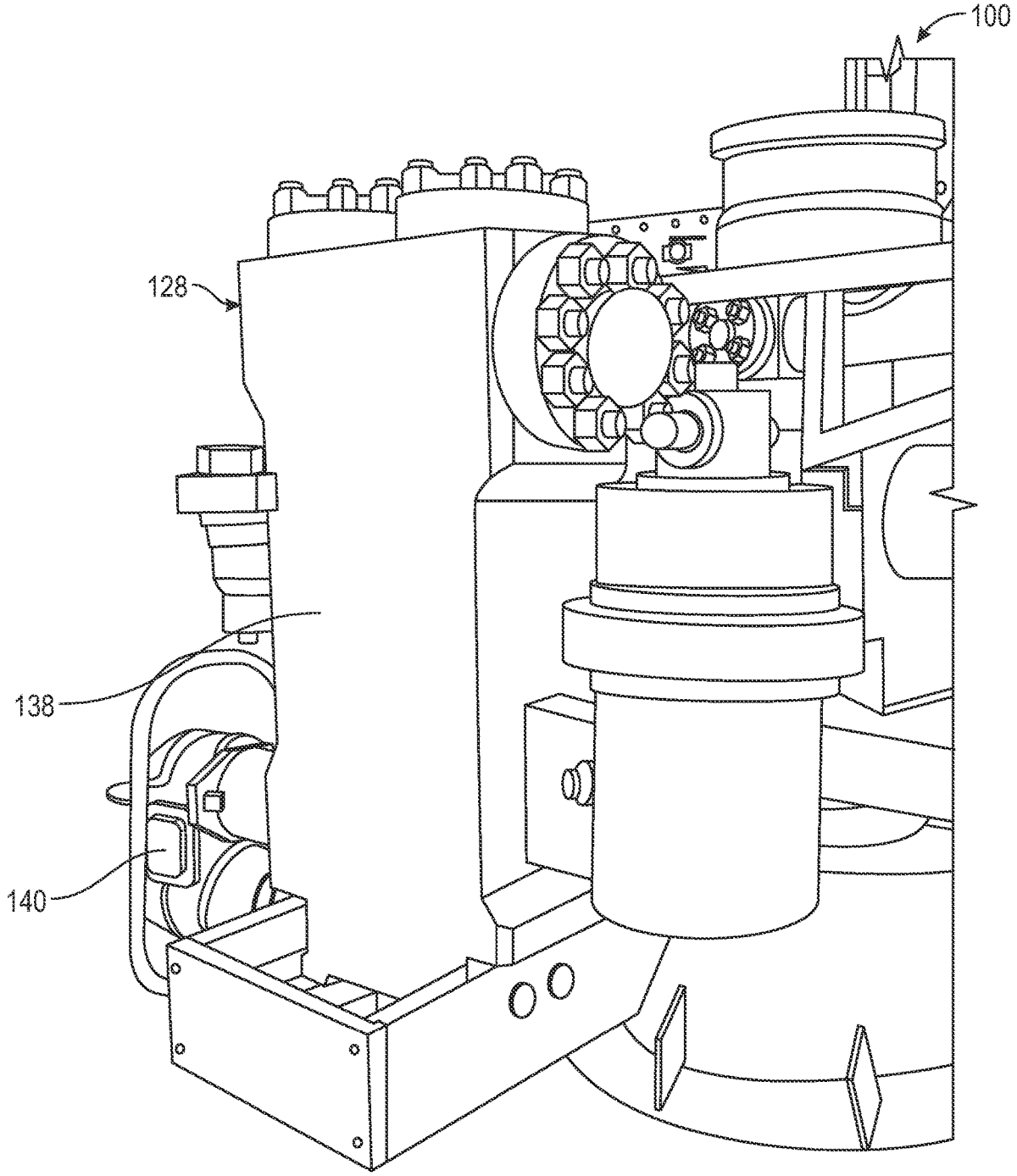
Figure 14:
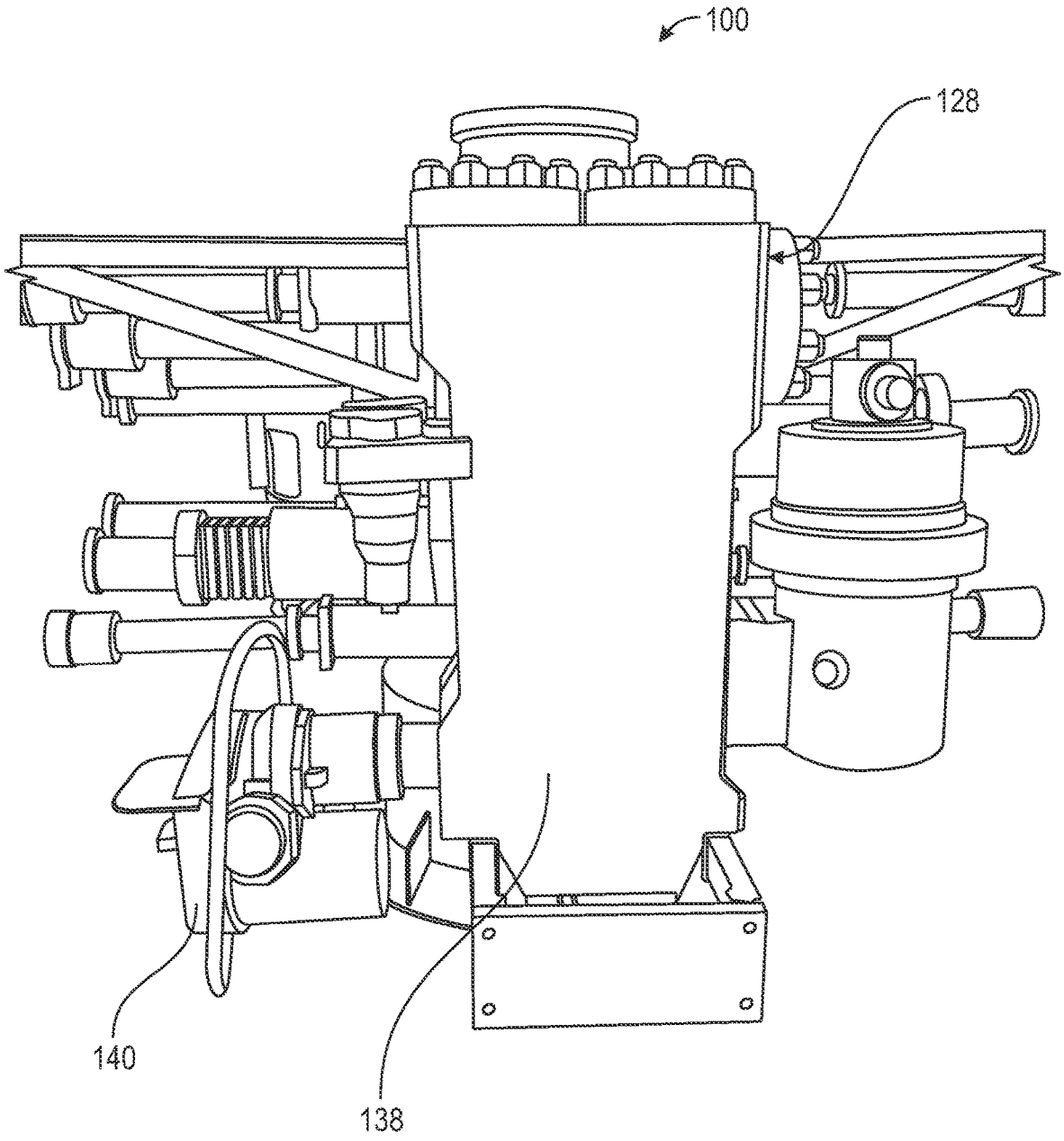
Figure 15:
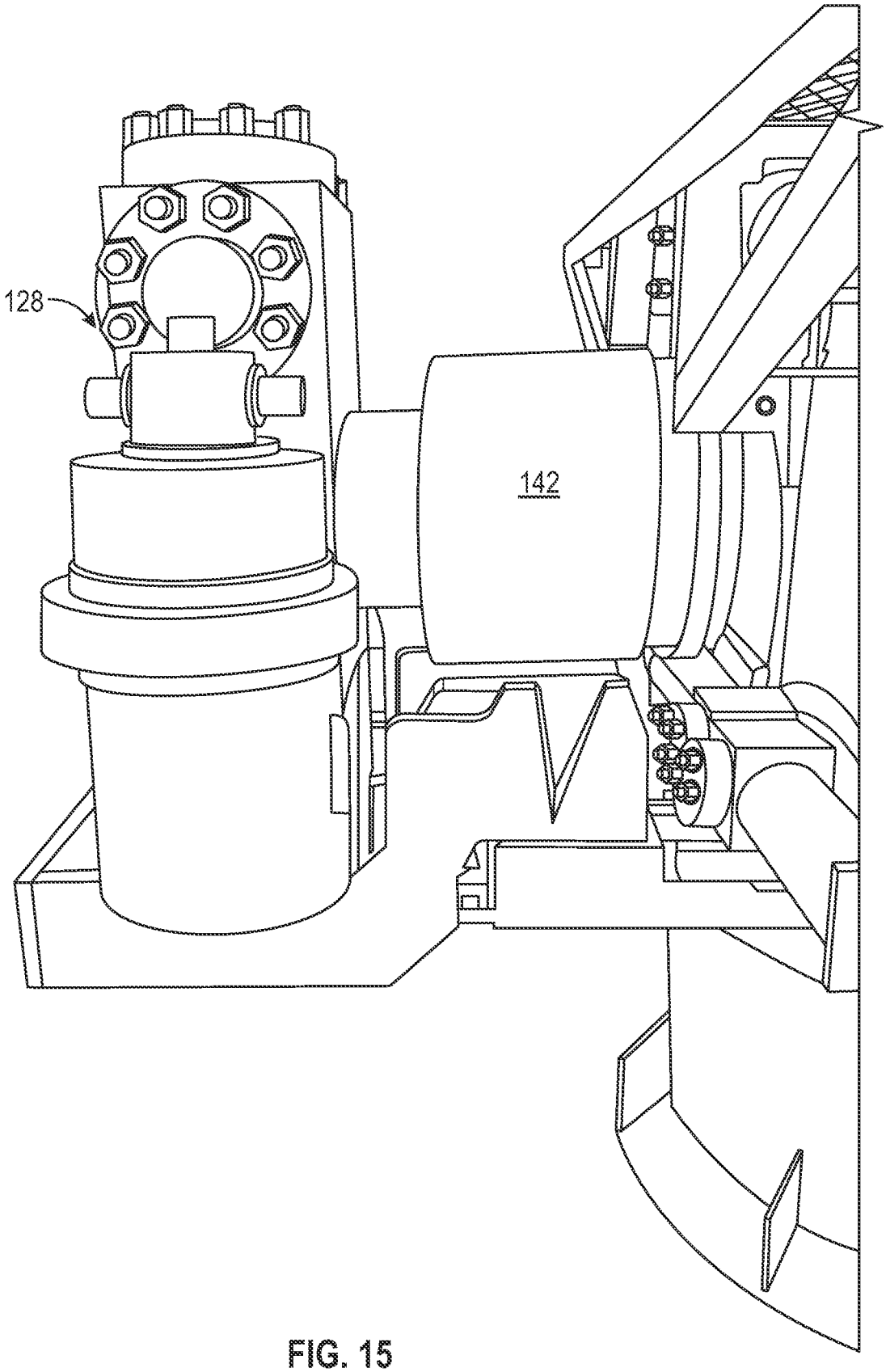

FIGS. 7-18 are three dimensional depictions of an embodiment of the ultra-compact tree 100 taken from various views to show certain features of the present disclosure. FIG. 8 is a view of the tree 100 showing the valve block 102, the outlet hub 36, the connector 160, the mandrel 162 and the actuators for certain of the production and annulus valves. In FIG. 8, the valve actuators are shown to extend from generally opposite sides of the valve block 102. FIG. 9 is a view of the tree 100 showing the flow module 128 connected to the valve block 102 via the hub and connector 142. FIG. 9 also shows the outlet hub 136, which in this embodiment of the tree 100 is located generally diametrically opposite the flow module 128, and the actuators for certain of the production and annulus valves. FIGS. 10-12 are additional views of the tree 100, and in particular the outlet hub 36 and the actuators for certain of the production and annulus valves. FIGS. 13-15 are views of the flow module 128, including the flow meter 138 and the choke 140. FIG. 15 also shows the hub and connector 142 for connecting the flow module 128 to the valve block 102.

Figure 16:
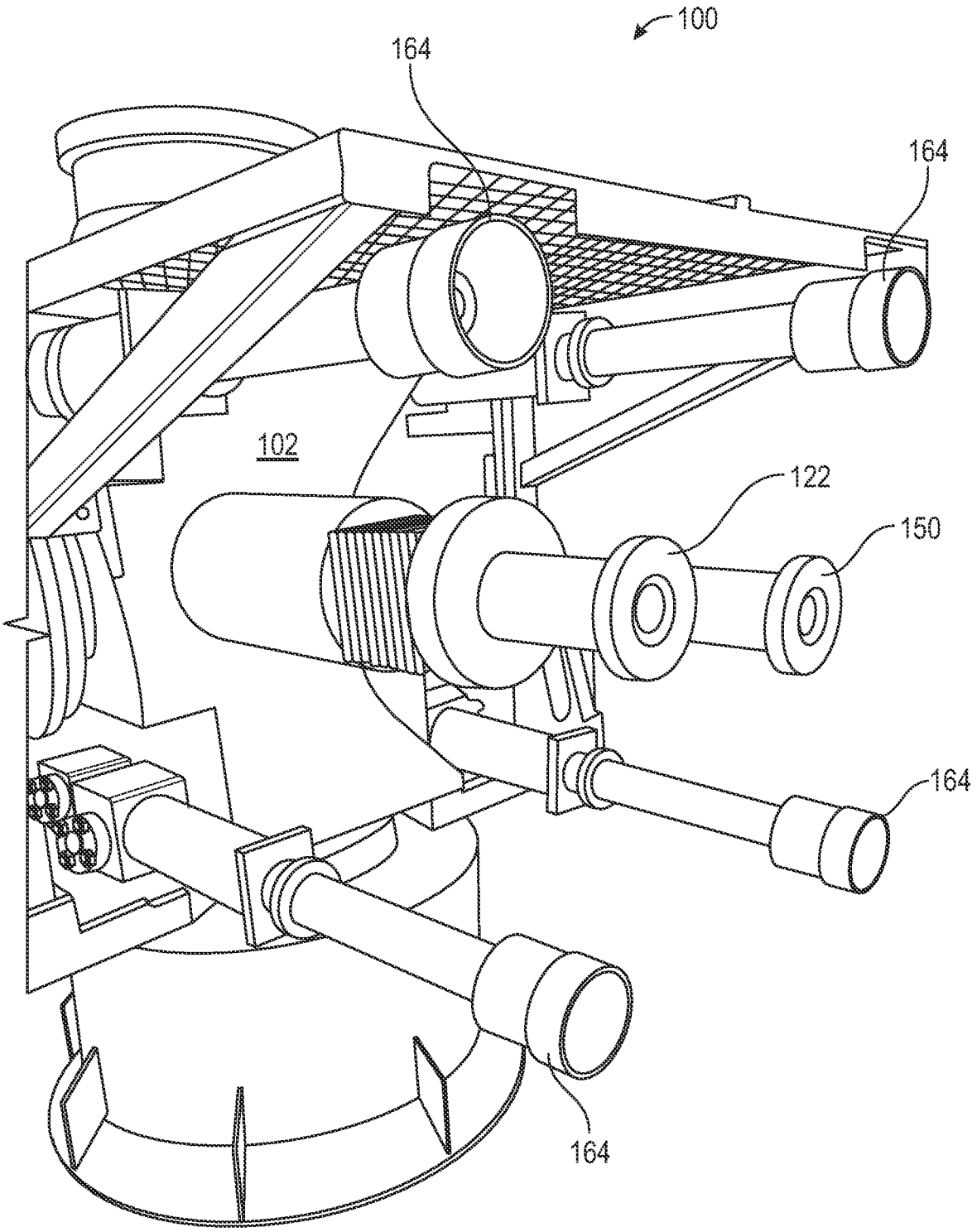
Figure 17:
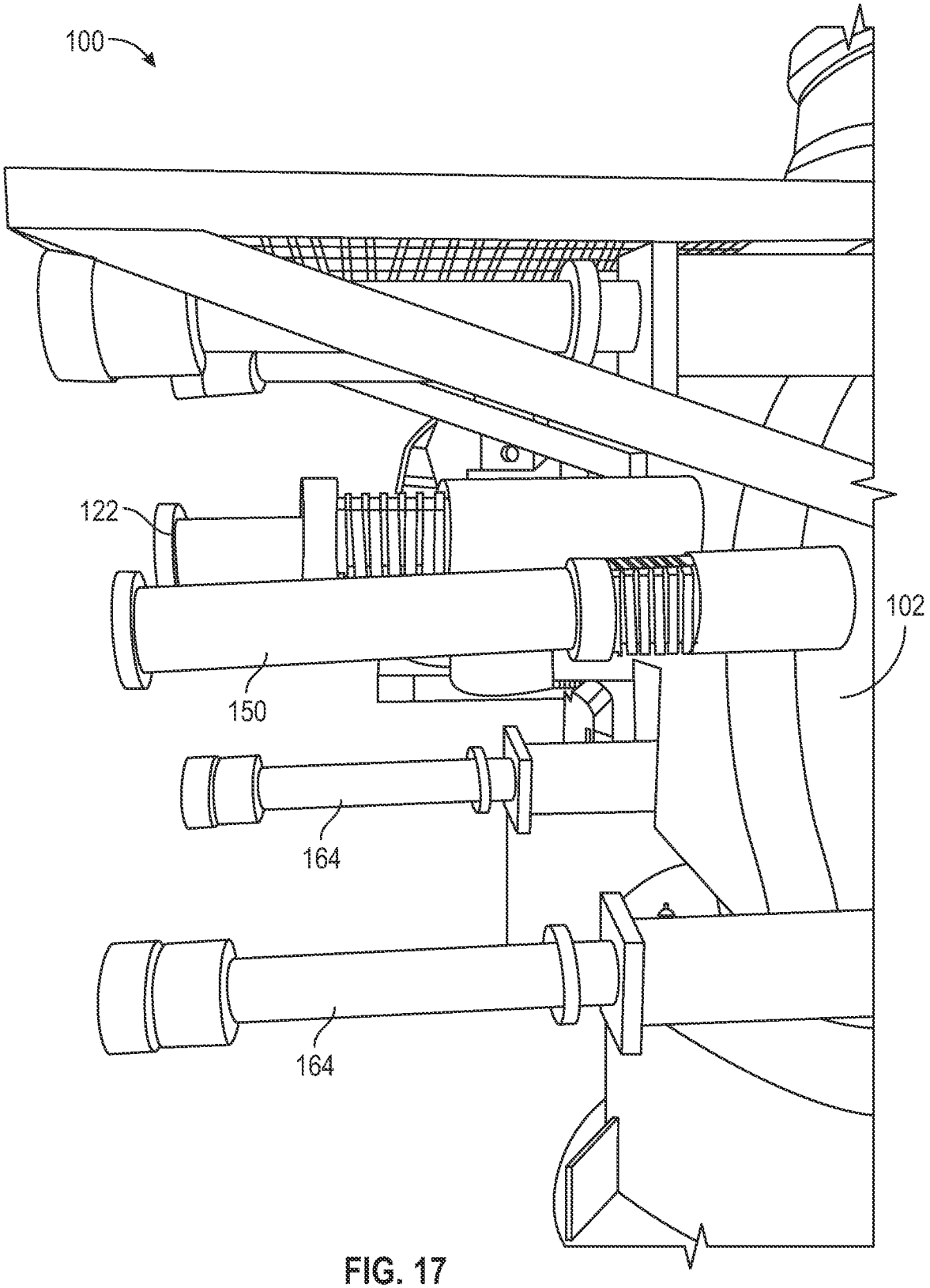
Figure 18:
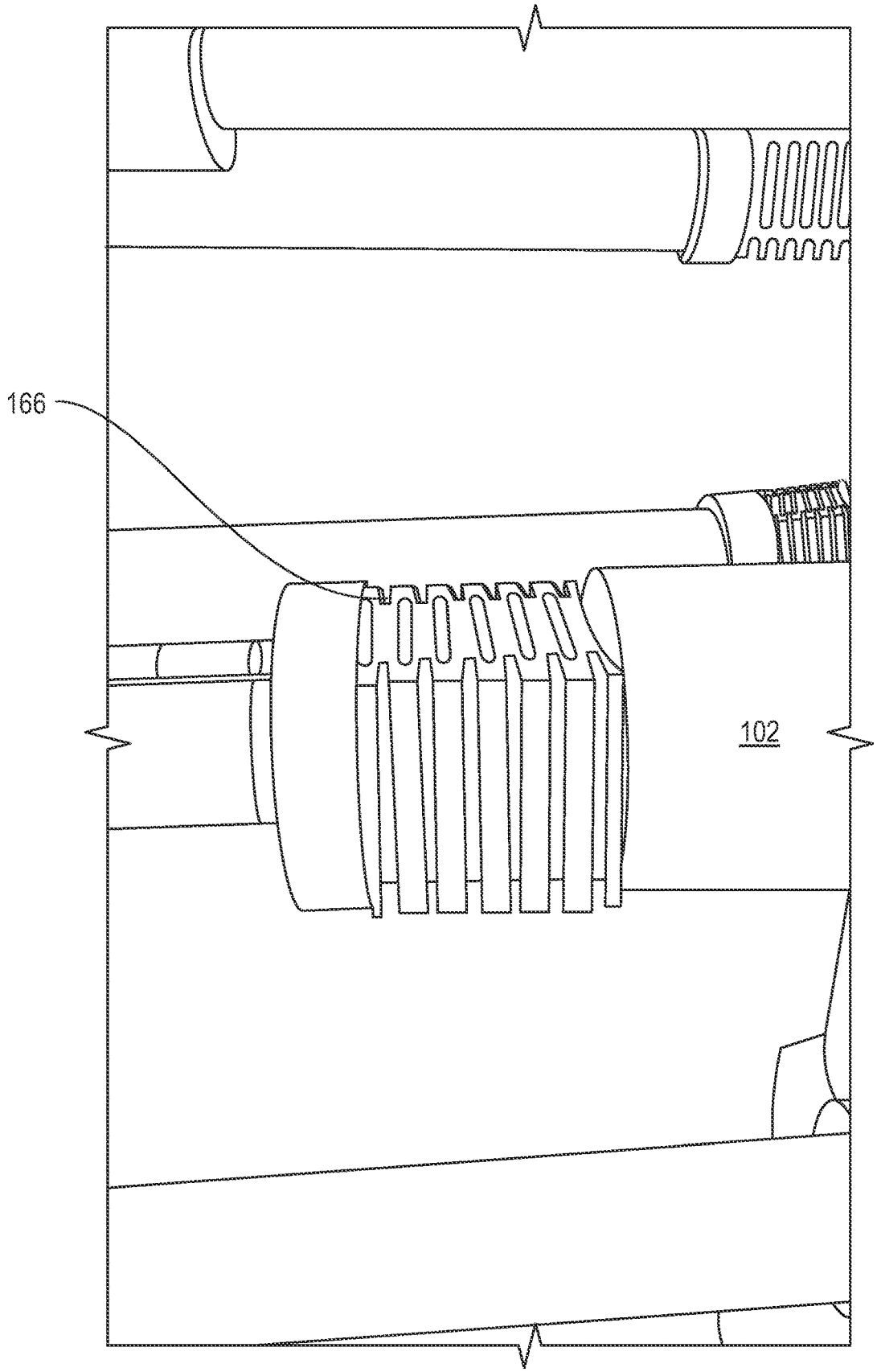

FIGS. 16 and 17 are views of the tree 100 showing the valve block 102 and the actuators for certain of the production and annulus valves. The actuators for the PMV 122 and the AMV 150 may comprise, for example, a hydraulic actuator of the type disclosed in applicant's co-pending International Patent Application No. PCT/BR2015/050033, published on Oct. 1, 2015 under International Publication No. WO 2015/143524 A2, which is hereby incorporated herein by reference. Moreover, these actuators may comprise a composite return spring 166 of the type described in applicant's co-pending International Patent Application No. PCT/BR2015/050255 filed on Dec. 14, 2015, which is hereby incorporated herein by reference.

It should be recognized that, while the present disclosure has been presented with reference to certain embodiments, those skilled in the art may develop a wide variation of structural and operational details without departing from the principles of the disclosure. For example, the various elements shown in the different embodiments may be combined in a manner not illustrated above. Therefore, the following claims are to be construed to cover all equivalents falling within the true scope and spirit of the disclosure.

What is claimed is:

1. A subsea christmas tree comprising:

a valve block which comprises a generally axially extending production bore, a first production branch which extends generally laterally through the valve block from the production bore, the first production branch comprising a first end which is connected to the production bore and a second end which is located on a side of the valve block, and a second production branch which extends generally laterally through the valve block from a first side of the valve block to a second side of the valve block, the second production branch comprising a first end which is located on the first side of the valve block and a second end which is located on the second side of the valve block;

at least one flow component which is connected to the valve block, the flow component comprising a first end which is in fluid communication with the second end of the first production branch and a second end which is in fluid communication with the first end of the second production branch; and an outlet hub which is connected to the second end of the second production branch, the outlet hub being directly physically connected to or formed integrally with the valve block;

wherein the second production branch does not intersect either the production bore or the first production branch.

2. The christmas tree of claim 1, wherein the first production branch extends from the production bore to the first side of the valve block, whereby the second end of the first production branch is located on the first side of the valve block.

3. The christmas tree of claim 2, wherein the at least one flow component comprises a production flow loop which includes an inlet that is connected to the second end of the first production branch and an outlet that is connected to the first end of the second production branch.

4. The christmas tree of claim 3, further comprising at least one of a production flow meter and a production choke which is positioned in the flow loop.

5. The christmas tree of claim 3, further comprising a production flow meter and a production choke which are positioned in series in the production flow loop.

6. The christmas tree of claim 4 or 5, wherein the production flow meter and/or the production choke form part of a flow module which is connected to the valve block.

7. The christmas tree of claim 6, wherein the flow module is retrievable independently of the valve block.

8. The christmas tree of claim 7, wherein the inlet and outlet of the production flow loop are respectively connected to the second end of the first production branch and the first end of second production branch through a single multi-bore hub and connector arrangement.

9. The christmas tree of claim 7, wherein the inlet of the production flow loop is connected to the second end of the first production branch through a first hub and connector arrangement and the outlet of the production flow loop is connected to the first end of the second production branch through a second hub and connector arrangement.

10. The christmas tree of claim 1, further comprising:

a production master valve which is positioned in the production bore below the first production branch;

a production wing valve which is positioned in the first production branch; and a production shut down valve which is positioned in the second production branch;

wherein the production master valve, the production wing valve and the production shut down valve are mounted in the valve block.

11. The christmas tree of claim 10, wherein the valve block further comprises a generally axially extending annulus bore and an annulus outlet which extends through the valve block from the annulus bore.

12. The christmas tree of claim 11, further comprising;

an annulus master valve which is positioned in the annulus bore below the annulus outlet; and an annulus wing valve which is positioned in the annulus outlet;

wherein the annulus master valve and the annulus wing valve are mounted in the valve block.

13. The christmas tree of claim 12, wherein the valve block further comprises a crossover bore which extends through the valve block from one of the production bore and the first production branch to one of the annulus bore and the annulus outlet.

14. The christmas tree of claim 13, further comprising a crossover valve which is positioned in the crossover bore, wherein the crossover valve is mounted in the valve block.

15. A subsea christmas tree comprising:

a valve block which comprises a production bore, a first production branch which extends laterally through the valve block from the production bore, and a second production branch which extends laterally completely through the valve block;

at least one flow component which is connected to a first side of the valve block, the at least one flow component being in fluid communication with the first production branch and the second production branch; and an outlet hub which is directly physically connected to or formed integrally with a second side of the valve block, the outlet hub being connected to the second production branch;

wherein the second production branch does not intersect either the production bore or the first production branch.

16. The christmas tree of claim 15, wherein the first production branch extends from the production bore to the first side of the valve block and the second production branch extends from the first side of the valve block to the second side of the valve block.

17. The christmas tree of claim 16, wherein the at least one flow component comprises at least one of a production flow loop, a production flow meter and a production choke.

18. The christmas tree of claim 17, wherein the at least one flow component forms part of a flow module which is connected to the valve block.

19. The christmas tree of claim 18, wherein the flow module is retrievable independently of the valve block.

20. The christmas tree of claim 19, wherein the first production branch and the second production branch are connected to the flow module through a single multi-bore hub and connector arrangement.

21. The christmas tree of claim 19, wherein the first production branch is connected to the flow module through a first hub and connector arrangement and the second production branch is connected to the flow module through a second hub and connector arrangement.

22. The christmas tree of claim 15, further comprising:

a production master valve which is positioned in the production bore below the first production branch;

a production wing valve which is positioned in the first production branch; and a production shut down valve which is positioned in the second production branch;

wherein the production master valve, the production wing valve and the production shut down valve are mounted in the valve block.

23. The christmas tree of claim 22, wherein the valve block further comprises a generally axially extending annulus bore and an annulus outlet which extends through the valve block from the annulus bore.

24. The christmas tree of claim 23, further comprising;

an annulus master valve which is positioned in the annulus bore below the annulus outlet; and an annulus wing valve which is positioned in the annulus outlet;

wherein the annulus master valve and the annulus wing valve are mounted in the valve block.

25. The christmas tree of claim 24, wherein the valve block further comprises a crossover bore which extends through the valve block from one of the production bore and the first production branch to one of the annulus bore and the annulus outlet.

26. The christmas tree of claim 25, further comprising a crossover valve which is positioned in the crossover bore, wherein the crossover valve is mounted in the valve block.

* * * * *